US006830723B2

(12) United States Patent
Larouche et al.

(10) Patent No.: US 6,830,723 B2
(45) Date of Patent: Dec. 14, 2004

(54) APPARATUS FOR TREATING MOLTEN METAL HAVING A SEALED TREATMENT ZONE

(75) Inventors: Richard Larouche, Chicoutimi (CA); Daniel Maltais, Chicoutimi (CA)

(73) Assignee: Alcan International Limited, Montreal (CA)

( * ) Notice: Subject to any disclaimer, the term of this patent is extended or adjusted under 35 U.S.C. 154(b) by 27 days.

(21) Appl. No.: 10/384,481

(22) Filed: Mar. 7, 2003

(65) Prior Publication Data

US 2003/0197315 A1 Oct. 23, 2003

Related U.S. Application Data

(63) Continuation-in-part of application No. 10/256,462, filed on Sep. 27, 2002, now abandoned.
(60) Provisional application No. 60/326,328, filed on Oct. 1, 2001.

(51) Int. Cl.[7] ..... C21C 7/00
(52) U.S. Cl. ..... 266/207; 266/275; 432/250
(58) Field of Search ..... 266/207, 275, 266/264; 432/254.1, 237, 250

(56) References Cited

U.S. PATENT DOCUMENTS

| | | | | |
|---|---|---|---|---|
| 2,278,275 A | * | 3/1942 | MacDonell | 266/207 |
| 3,622,137 A | * | 11/1971 | Drehsen et al. | 432/237 |
| 3,955,806 A | | 5/1976 | Westerhuis et al. | |
| 4,040,610 A | | 8/1977 | Szekely | 266/235 |
| 4,456,478 A | | 6/1984 | Metz et al. | 75/53 |
| 4,529,176 A | * | 7/1985 | Bloom et al. | 266/242 |
| 4,638,980 A | | 1/1987 | Beele | 266/44 |
| 5,656,235 A | | 8/1997 | Sarlitto et al. | 266/207 |
| 5,660,614 A | | 8/1997 | Waite et al. | 75/680 |
| 5,846,479 A | | 12/1998 | English | 266/47 |
| 2003/0080480 A1 | | 5/2003 | Larouche et al. | |

FOREIGN PATENT DOCUMENTS

| | | |
|---|---|---|
| DE | 11 11 833 B | 7/1961 |
| GB | 602933 | 6/1948 |
| GB | 843975 | 8/1960 |
| JP | 3 291129 | 12/1991 |

* cited by examiner

*Primary Examiner*—Scott Kastler
(74) *Attorney, Agent, or Firm*—Cooper & Dunham LLP

(57) ABSTRACT

An apparatus for treating molten metal includes a treatment vessel for holding molten metal and a removable cover or hood for the vessel. Sealing means are provided between the cover and the vessel to provide a gas tight treatment zone. The sealing means include mating peripheral flanges on the vessel and cover, with the cover flange having two spaced annular sealing strips for contacting the vessel flange and a metal annular splash protector. These sealing strips include a thermal barrier strip formed of a deformable fibrous refractory material to provide a gas tight, a thermal barrier between the interior of the vessel and the exterior and a metal annular strip upon which the cover is supported on the vessel with the cover flange at a fixed distance above the vessel flange and the thermal barrier strip is compressed therebetween to a controlled degree.

27 Claims, 3 Drawing Sheets

APPARATUS FOR TREATING MOLTEN METAL HAVING A SEALED TREATMENT ZONE

CROSS-REFERENCE TO RELATED APPLICATION

This application claims the benefit of Provisional Application Ser. No. 60/326,328, filed Oct. 1, 2001 and is a continuation-in-part of U.S. application Ser. No. 10/256,462, filed Sep. 27, 2002, now abandoned.

FIELD OF THE INVENTION

This invention relates to an apparatus for the treatment of molten metal and, more particularly, for degassing molten metal in a sealed treatment zone.

DESCRIPTION OF THE PRIOR ART

When many molten metals are used for casting and similar processes they must be subjected to a preliminary treatment to remove unwanted components that may adversely affect the physical or chemical properties of the resulting cast product. For example, molten aluminum and aluminum alloys derived from alumina reduction cells or metal holding furnaces usually contain dissolved hydrogen, solid non-metallic inclusions and various reactive elements. The dissolved hydrogen comes out of solution as the metal cools and forms unwanted porosity in the product. Non-metallic solid inclusions reduce metal cleanliness and the reactive elements and inclusions create unwanted metal characteristics. This treatment is frequently carried out in a vessel or trough section in-line with the metallurgical trough used to convey the metal from the holding furnace to the casting machine.

These undesirable components are normally removed from molten metals by introducing a gas below the metal surface by means of gas injectors. As resultant gas bubbles rise through the mass of molten metal, the absorb gases dissolve in the metal and remove them from the melt. This process is often referred to as "metal de-gassing" or "in-line metal de-gassing".

A typical prior gas treatment apparatus for molten metals is described in Waite et al. U.S. Pat. No. 5,660,614, issued Aug. 26, 1997. This apparatus uses a hood to collect off-gases and dust, and various baffles are used to control the flow of metal through the de-gasser. Such a unit does not provide a gas-tight seal.

Molten metals are also treated by means of in-line filtration to remove particulates. Such filters generally consist of box-like or trough-like arrangements containing a filter media which may be a porous refractory plate or granular refractory material in a bed. Filter units are sometimes combined with de-gassers.

There are demands from environmental protection agencies to provide a completely sealed unit for treatment of molten metals so that less particulate is generated and less is exhausted to the atmosphere. The objective is to create a substantially air-free operation which reduces dross and hence dust formation. This is particularly the case for in-line metal degassing where there is a requirement to exhaust the treatment gases from the treatment vessel without leakage into or out of the treatment vessel.

However, equipment for treatment of molten aluminum operates at high temperatures and frequently agitates the molten metal, causing splashing. At the same time operational considerations require periodic opening of the equipment, for example to skim off dross or otherwise clean the equipment.

In English, U.S. Pat. No. 5,846,749, issued Dec. 8, 1998, a metal de-gassing apparatus is described which, along other things, attempts to provide a gas-tight sealed treatment zone. Baffles or underflow weirs are provided at the inlet and outlet of the vessel to act as air-locks, and the patent shows a rather complicated system with a plurality of bolts for holding a cover plate snuggly on the treatment vessel. This does not allow for the fact that the cover must be removed quite often for servicing of gas injectors and for cleaning a residue dross.

In Sarlitto et al., U.S. Pat. No. 5,656,235, issued Aug. 12, 1997, a metal de-gassing apparatus is described which includes air-locks at the inlet and outlet of the vessel. The cover appears in this case to rest on the top surface of the vessel.

It is an object of the present invention to provide an improved form of sealing arrangement between the cover plate of an apparatus for treatment of molten metal and the treatment vessel.

It is a further object of the invention to provide a sealing arrangement which will provide an air-tight seal while permitting the treatment vessel cover to be removed easily.

It is a further object of the invention to provide an in-line metal treatment vessel that provides for minimum gas escape or air inflow whilst being readily opened for dross removal and other servicing requirements.

SUMMARY OF THE INVENTION

The present invention in its broadest aspect relates to an apparatus for treating molten metal, preferably as an in-line treatment vessel for treating molten metal flowing between a holding furnace and casting machine. It comprises a treatment vessel for holding molten metal. A removable cover or hood is provided for the treatment vessel with sealing means between the cover and the vessel to provide a gas tight treatment zone. The sealing means comprises mating peripheral flanges on the vessel and cover. Lying between the flanges and adapted to contact the mating faces of both flanges when the cover or hood is in place are at least two strips. These strips include an annular thermal barrier strip formed of a deformable refractory material and adapted to provide a gas leak resistant, thermal barrier between the interior of the vessel and the exterior and an metal strip adapted to provide a mechanical contact between the two mating faces and preferably to control the degree of compression applied to the thermal barrier strip. The at least two strips include an inner metallic face providing a metal splash shield to protect the sealing strips and the space between the mating faces from metal splashes.

The term "inside" as used herein means on the side closer the interior of the treatment vessel and closer to the molten metal held therein. The term "outside" means on the side further from the vessel interior.

The "removable" cover or hood means a hood that can be either completely removed or opened, for example, on hinges attached to the treatment vessel, to permit easy or rapid access to the interior of the treatment vessel.

In one preferred embodiment, the metal strip is located inside the thermal barrier strip and its inner surface acts as the splash protection as well as providing a mechanical contact and spacing control.

In another preferred embodiment, the metal strip is located outside the thermal barrier, that is, the splash protection is separate from the metal strip and is provided as a separate metal strip attached to one of the mating faces. It preferably extends to a point close to, but not necessarily in contact with the opposite mating face so that the outer metal annular strip controls the spacing between the mating faces.

In yet another preferred embodiment, a additional gas sealing strip formed from an elastomeric material is also used, such a seal being in the form of an annular strip located outside the thermal barrier strip, and lying between the mating faces and is thereby thermally protected by the refractory material since such materials are not resistant to either metal splashes or high temperature. More preferably, when the metal strip is separate and outside the thermal barrier strip, the gas sealing strip is located outside the metal strip. The additional gas sealing strip may be used in circumstances where the apparatus must be particularly well sealed. When a gas sealing strip is provided, the metal strip is preferably used to control compression on both the thermal barrier strip and the gas sealing strip.

In trying to obtain a good seal between a cover and a processing vessel, flexible materials are advantageous because of their sealing properties. However, such materials are not generally resistant to the reactive nature of metals being processed. The metals being agitated in the vessel will occasionally splash and contact a seal. Seals having good leak tightness and good thermal resistance are sometimes formed from refractory rope, paper or similar materials, but these have poor resistance to molten aluminum or similar reactive metals, as well as lacking sufficient sealing properties to provide an airtight seal.

In the multi-part seal of the present invention an innermost splash barrier is provided as a first line metal barrier preventing molten metal from penetrating further between the flanges. In some embodiments it also serves to support the flange of the cover plate at a fixed distance above the flange of the treatment vessel and thereby control the degree of compression on the other two sealing strips. The thermal barrier strip is preferably formed from strip of deformable refractory material, preferably in the form of rope, felt or paper, and is of such a size that it is squeezed somewhat between the cover plate and vessel flanges and this provides a partial seal as well as a thermal barrier. Such sealing strips may be formed from an inner core of metal rope or mesh, or of refractory rope, which is then wrapped in a refractory cloth or strip. The metal strip and any splash barrier separate from the metal strip typically have a square or rectangular cross-section, while the thermal barrier strip is typically of a round or oval configuration. The gas sealing strip, when used, may be of square or rectangular cross-section or of a rounded cross-section, e.g. oval or round.

All strips (metal strip, thermal barrier strip, gas sealing strip and metal splash shield) are preferably annular strips that are continuous around the sides and ends of the vessel. This is particularly important for the strip forming the main leak resistant or airtight seal, whether it is the fibrous refractory seal or the optional elastomeric sealing strip. The vessel cover may be round, square, rectangular, etc., and the annular sealing strips generally correspond to the shape of the cover.

In one embodiment of the invention, the flange face on the treatment vessel is flat and the various strips are connected to the flange of the cover.

In another embodiment of the invention, the flange face on the treatment vessel has one or more raised, curved ridges located so that that one or more of the strips will contact the ridges. In particular it is advantageous to provide such a ridge for a gas sealing strip, when used, so as to improve the sealing capabilities.

The cover of the treatment vessel equipped with such multi-part seals can be adapted so that in use it rests on the mating surface of the treatment vessel and seals under its own weight. If more positive sealing is required, quick release clamps may be used, but in either case, sealing is obtained without the use of bolts or similar devices, and the cover can be easily and quickly removed and replaced for servicing.

The treatment vessel of the invention is typically an apparatus for de-gassing molten metal and it may include gas injector rotors extending downwardly from the cover and into the treatment zone. It also typically includes ventilators for safely removing gases from the treatment zone.

The treatment vessel also preferably has baffles, airlocks, or underflow weirs positioned at the entrance and exit of the treatment vessel to provide, along with the seal between the cover and vessel flanges, a completely air-tight and leak-tight vessel for treatment of molten metal.

DESCRIPTION OF THE PREFERRED EMBODIMENTS

Figure 1:
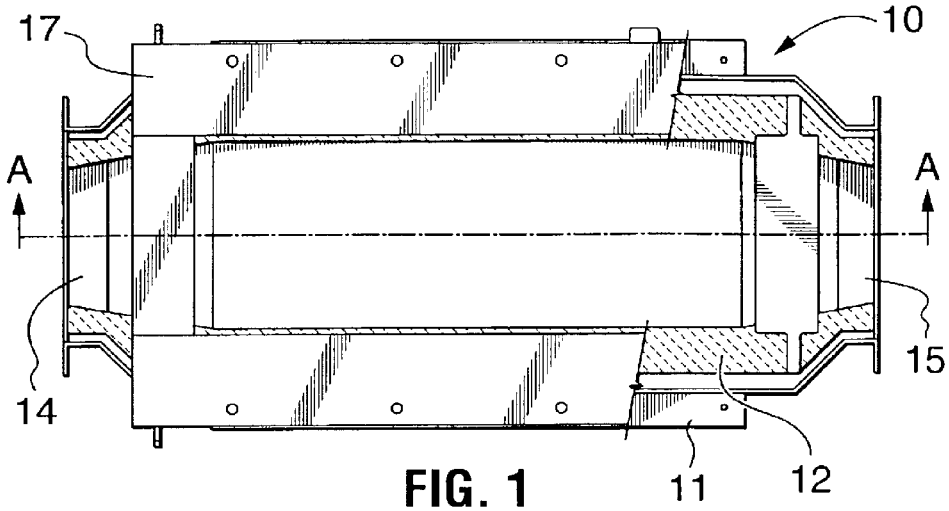
FIG. 1 is a plan view in partial section of a de-gassing trough unit.
Figure 2:
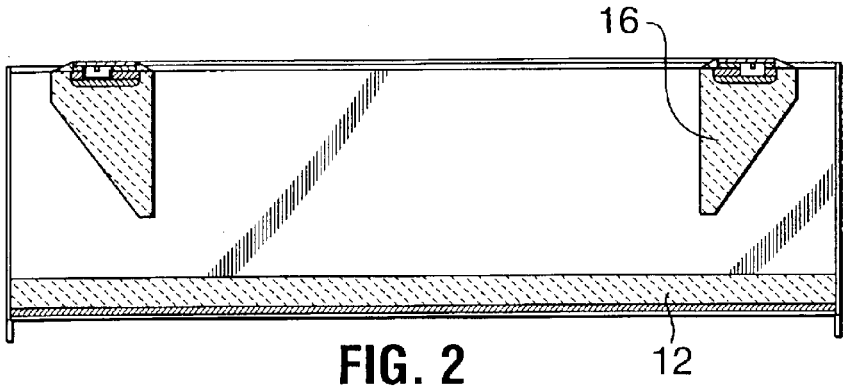
FIG. 2 is a vertical section along line A—A of FIG. 1.
Figure 3:
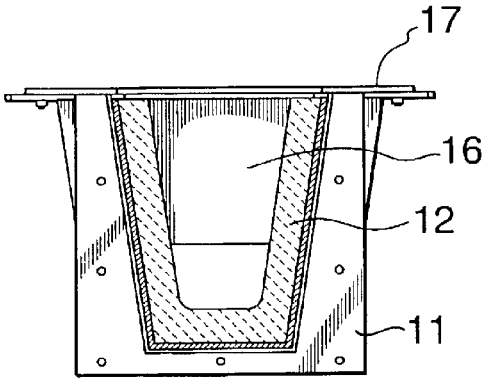
FIG. 3 is a vertical cross-section of the trough unit.

The drawings show several embodiments of the invention as it relates to a de-gassing apparatus for molten metals. This includes a de-gassing trough unit 10 supported by a framework 11 and being lined by a ceramic liner 12. The trough holds a body of molten metal 13 which is fed in through molten metal inlet 14 and is discharged through molten metal outlet 15. Ceramic or refractory baffles 16 are provided at each end of the treatment zone to act as "air-locks" at the point of metal entry and exit from the vessel. A flat metal flange 17 surrounds the top of the trough 10.

Figure 4:
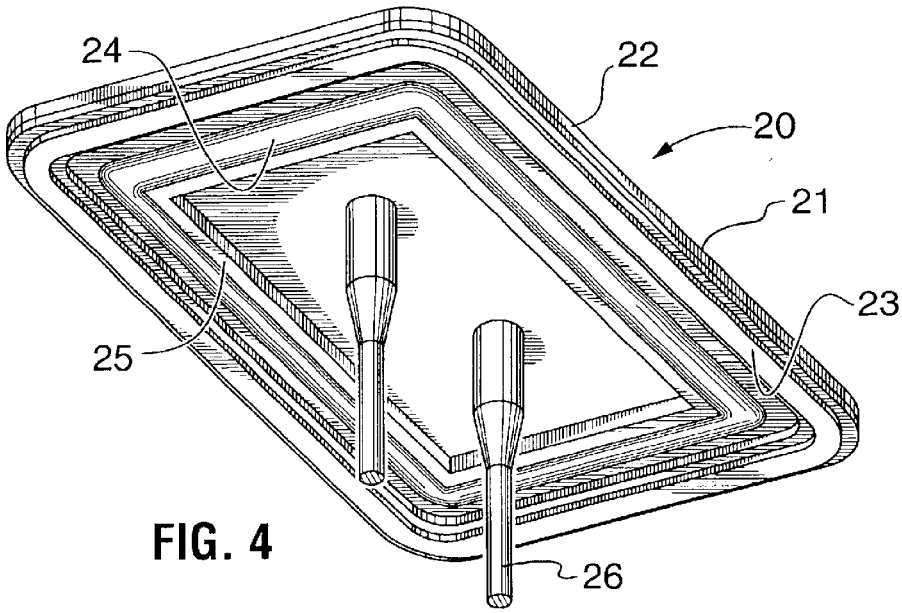
FIG. 4 is a perspective view of the bottom of a cover.
Figure 5:
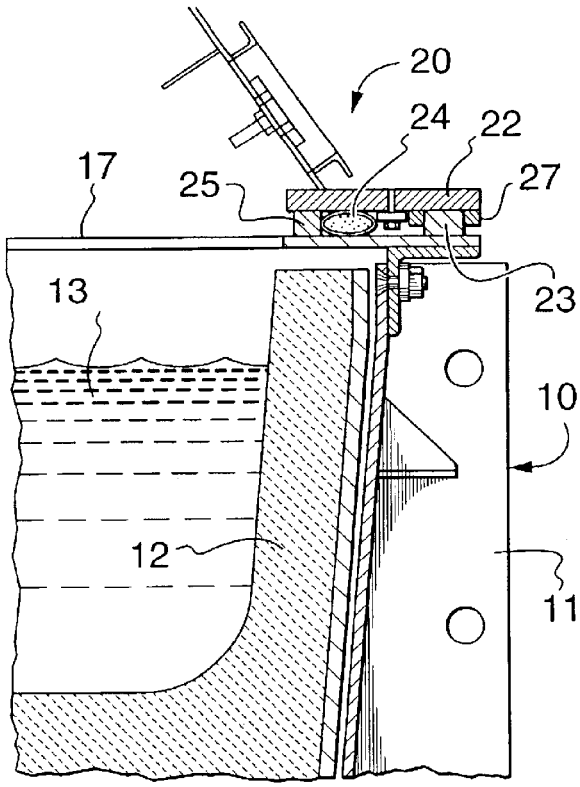
FIG. 5 is a sectional view showing details of a sealing arrangement.

A cover unit 20 fits over the de-gassing trough unit 10 and sits on the flange plate 17. As seen from FIGS. 4 and 5, the cover unit includes a heavy steel plate portion 21 which includes an edge flange 22. The cover supports downwardly projecting gas injection rotors 26, of which the shafts only are shown. Suitable rotors are described for example in U.S. Pat. No. 5,660,614.

Fixed to the bottom face of the edge flange 22 are three (optionally two) strips. These strips include a first inner strip 25 which is a solid steel strip of square or rectangular shape. This metal strip acts as a mechanical protection from metal splashing from the de-gassing trough. The metal strip 25 also bears the weight of the cover 20 and allows a predicted amount of compression on strips 24 and 23. The middle strip 24 is made of a metal mesh or ceramic fiber rope wrapped in refractory, e.g. silica, fabric material. Its principle characteristic is its ability to withstand high temperatures. The third strip 23 is optional in some embodiments and is preferably square or rectangular in shape and is formed of an elastomeric material, e.g. a silicon material, and acts as a barrier against gaseous emissions. It is held between shoulder portions 27. The characteristics of this seal 23 are selected for its elasticity and flexibility, and thus ensures a tight seal on the surface of the trough even if the surface is slightly irregular. This third strip is used in situations that require particularly good gastight sealing.

In one preferred embodiment, the inner strip is a solid steel strip having dimensions of about 22 mm by 22 mm, the middle strip 24 has a diameter of about 35 mm and the outer strip has a width of about 35 mm and a height of about 25 mm. When the cover 20 is in place on the de-gassing trough unit 10, it can be seen that the intermediate seal and the outer seal are compressed down to 22 mm which is the height of the steel strip 25. By supporting the cover on the inner steel strips 25, the controlled compression of the middle strip 24 and the outer strip 23 assure a longer seal life and also a better sealing efficiency.

Figure 6:
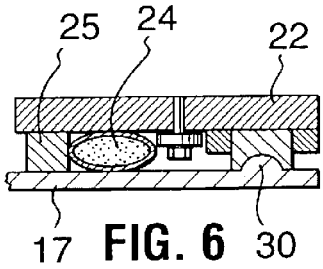
FIG. 6 is a sectional view showing details of a further sealing arrangement.

FIG. 6 shows an alternate embodiment of the elastomeric seal, in which a continuous semi-circular ridge 30 is provided on the surface of the lower flange 17 so that it contacts and locally compresses the elastomeric strip 30, thus providing effective gas tight sealing.

Figure 7:
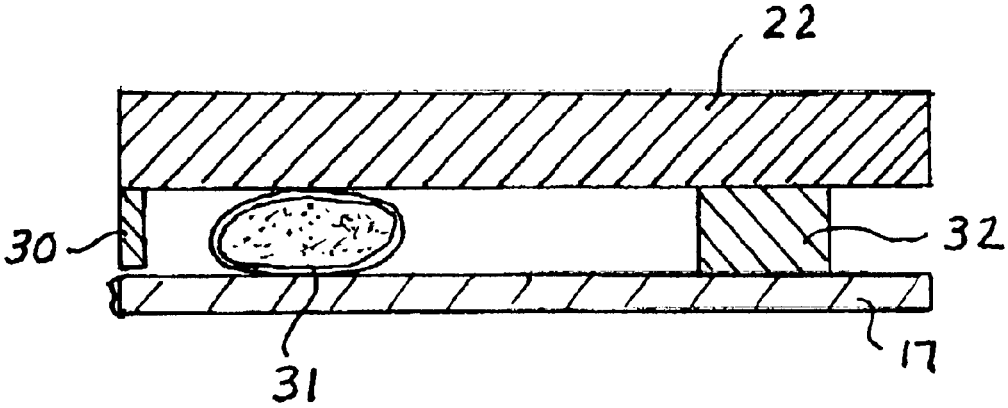
FIG. 7 is a sectional view showing details of a further sealing arrangement.

FIG. 7 shows yet another alternate embodiment of the sealing system that does not use an elastomeric seal. An annular metal strip 30 is welded to the top flange 22 and extends downwards to almost touch the bottom flange 17. This provides a metal splash protection to the seals and flanges. An annular flexible refractory fibre strip 31 is provided outside the splash protection and serves as both thermal protection and also provides a leak resistant seal that is effective in many applications for preventing air ingress to the metal treatment vessel. An annular metal strip 32 is then provided in the next outermost position which supports the upper flange on the lower flange and thereby control the flange spacing and degree of compression of the seal 31.

Figure 8:
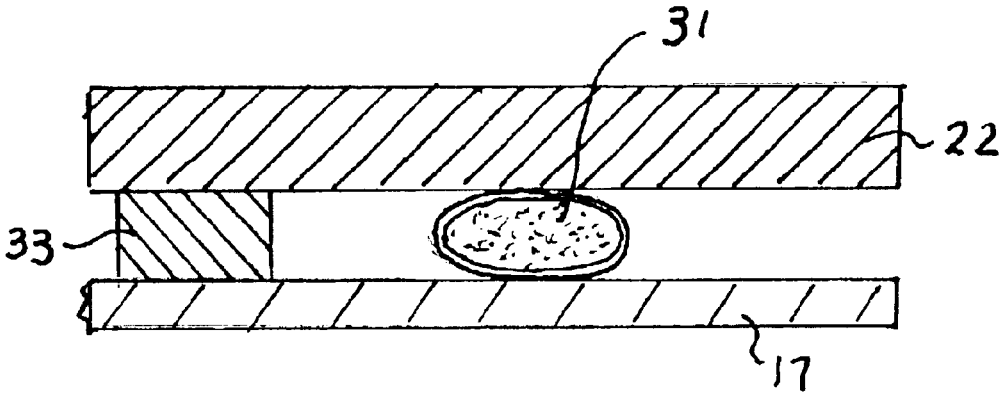
FIG. 8 is a sectional view showing details of a further sealing arrangement.

FIG. 8 shows yet another seal arrangement in which the annular metal strip 33 is located as the innermost member and serves as a spacing means to control the compression of the thermal and gas sealing strip 31 and also a means to protect the flanges and seals from metal splashes.

The seal between the cover 20 and the de-gassing trough 10 is maintained by the weight of the cover. However, quick release clamps (not shown) may also be used to hold the cover in place. When servicing of the de-gassing trough is required, the clamps are released and the cover is lifted by a lifting mechanism.

The de-gassing assembly also includes a ventilating system (not shown) for safely removing gases from the treatment zone.

What is claimed is:

1. An apparatus for in-line treatment of a molten metal, comprising:

a treatment vessel for holding said molten metal, a removable cover for the treatment vessel and sealing means between the cover and the vessel to provide a gas tight treatment zone, said sealing means comprising mating peripheral flanges on said vessel and said cover, having between said mating flanges at least two spaced sealing strips adapted to contact the mating faces of said mating flanges, said two sealing strips including an annular thermal barrier strip formed of a deformable refractory material adapted to provide a gas leak resistant, thermal barrier between the cover flange and the vessel flange and a metal strip providing a mechanical contact between the cover flange and the vessel flange, and including an inner metal face providing a splash shield to protect the annular strips and mating flanges from metal splashes.

2. Apparatus according to claim 1 wherein said metal strip is located inside the said thermal barrier strip, said metal strip having an inner surface which forms the metallic splash shield.

3. Apparatus according to claim 2 which further comprises an annular gas sealing strip formed from an elastomeric material, said gas sealing strip being located outside the said thermal barrier strip and adapted to contact the mating faces.

4. Apparatus according to claim 1 wherein the metal strip is located outside the thermal barrier strip and the metallic splash shield comprises a second metal strip inside the thermal barrier strip and attached to one of the mating faces and extends towards the opposite mating face.

5. Apparatus according to claim 4 which further comprises an annular gas sealing strip formed from an elastomeric material, said gas sealing strip being located outside the said metal strip and adapted to contact the mating faces.

6. The apparatus according to claim 1 wherein said thermal barrier strip and said metal strip are mounted on the face of one of the mating flanges.

7. The apparatus according to claim 1 wherein the metal strip has a square or rectangular cross-section.

8. The apparatus according to claim 1 wherein the thermal barrier strip comprises a refractory rope, felt or paper.

9. The apparatus according to claim 8 wherein the thermal barrier strip comprises a ceramic fiber rope wrapped in refractory fabric.

10. The apparatus according to claim 1 wherein the thermal barrier strip comprises a metal mesh core wrapped in a refractory fabric.

11. The apparatus according to claim 3 wherein the annular gas sealing strip has a square or rectangular cross-section.

12. The apparatus according to claim 3 wherein the annular gas sealing strip has an oval or round cross-section.

13. The apparatus according to claim 3 wherein the annular gas sealing strip is connected to the flange of the cover.

14. The apparatus according to claim 5 wherein the annular gas sealing strip has a square or rectangular cross-section.

15. The apparatus according to claim 5 wherein the annular gas sealing strip has an oval or round cross-section.

16. The apparatus according to claim 5 wherein the annular gas sealing strip is connected to the flange of the cover.

17. The apparatus according to claim 1 wherein the cover rests on the treatment vessel with the metal strip resting on the vessel flange and the thermal barrier strip slightly compressed between the cover and vessel flanges.

18. The apparatus according to claim 1 wherein the vessel flange has at least one curved ridge on its surface and at least one of said thermal barrier strip and said metal strip contacts a said curved ridge.

19. The apparatus according to claim 3 wherein the vessel flange has at least one curved ridge on its surface and the gas sealing strip contacts a said curved ridge.

20. The apparatus according to claim 5 wherein the vessel flange has at least one curved ridge on its surface and the gas sealing strip contacts a said curved ridge.

21. The apparatus according to claim 1 wherein the vessel has an inlet and outlet for connecting said vessel to a metallurgical trough, and wherein a baffle is placed at each of said inlet and said outlet to act as an airlock to prevent air entry or gas escape.

22. The apparatus according to claim 1 wherein the cover rests on the treatment vessel under its own weight.

23. The apparatus according to claim 1 wherein the cover is fixed to the treatment vessel by way of quick release clamping means.

24. The apparatus according to claim 1 wherein the treatment vessel comprises an apparatus for de-gassing molten metal.

25. The apparatus according to claim 24 which includes gas injection rotors extending downward from the cover and into the treatment zone.

26. The apparatus according to claim 24 which includes ventilator means for removing gases from the treatment zone.

27. An apparatus for in-line treatment of a molten metal, comprising:

a treatment vessel for holding said molten metal, a removable cover for the treatment vessel and sealing means between the cover and the vessel to provide a gas tight treatment zone, said sealing means comprising mating peripheral flanges on said vessel and said cover, having between said mating flanges three spaced annular sealing strips adapted to contact said mating faces, said three annular sealing strips including an outer annular strip formed of an elastomeric material adapted to provide an air-tight seal between the cover flange and vessel flange, a middle annular strip formed of a deformable refractory material adapted to provide a thermal barrier between the cover flange and the vessel flange and an inner metal annular strip providing a mechanical protection for said middle annular strip.

* * * * *